US005924162A

United States Patent [19]

Kalscheur et al.

[11] Patent Number: 5,924,162

[45] Date of Patent: Jul. 20, 1999

[54] WASTE RECEPTACLE WITH A SWEEPING RAMP HAVING PROTRUDING TEETH

[75] Inventors: Leo Peter Kalscheur; Kathleen Ellen Siggelkow, both of McFarland, Wis.

[73] Assignee: Leo Peter Kalscheur, McFarland, Wis.

[21] Appl. No.: 08/990,441

[22] Filed: Dec. 15, 1997

[51] Int. Cl.[6] ..... A47L 13/52

[52] U.S. Cl. ..... 15/257.2; 15/257.1; 15/257.3; 15/257.6; 15/142; 220/908; 220/531

[58] Field of Search ..... 15/257.1, 257.2, 15/257.3, 257.6, 142, 257.01; 220/501, 531, 908

[56] References Cited

U.S. PATENT DOCUMENTS

| | | | |
|---|---|---|---|
| 445,278 | 1/1891 | Chubb | 15/257.1 |
| 577,452 | 2/1897 | Richardson | 15/257.2 |
| 733,002 | 7/1903 | Burgess | 220/531 |
| 1,315,310 | 9/1919 | Kelley | 15/257.1 |
| 2,164,407 | 7/1939 | Jarchow | 15/257.3 |
| 2,304,193 | 12/1942 | Nielsen | 15/257.01 |
| 2,791,374 | 5/1957 | Lingg | 15/257.3 |
| 2,923,023 | 2/1960 | Lovinggood et al. | 15/257.6 |
| 3,017,652 | 1/1962 | Morabito | 15/257.5 |
| 3,056,993 | 10/1962 | Lewis | 15/142 |
| 3,671,995 | 6/1972 | Carr | 15/257.3 |
| 4,048,692 | 9/1977 | Coffey | 15/257.2 |
| 4,307,704 | 12/1981 | Wagg | 126/245 |
| 4,316,627 | 2/1982 | Solypa | 294/1.4 |
| 4,406,395 | 9/1983 | Scoggins | 232/43.1 |
| 4,795,046 | 1/1989 | Rath | 220/908 |
| 4,943,002 | 7/1990 | Fraher | 232/43.1 |
| 5,611,450 | 3/1997 | DeMars | 15/257.3 |

FOREIGN PATENT DOCUMENTS

| | | | |
|---|---|---|---|
| 268084 | 3/1927 | United Kingdom | 15/257.1 |

*Primary Examiner*—Mark Spisich
*Assistant Examiner*—Theresa T. Snider
*Attorney, Agent, or Firm*—DeWitt Ross & Stevens S.C.

[57] ABSTRACT

Shown and described is a waste receptacle suitable for receiving swept waste materials from a broom or similar cleaning implement. The waste receptacle includes a sweeping ramp having protruding teeth. Users may sweep waste up the sweeping ramp, and the teeth serve to hinder the escape of waste from the ramp as the broom head is withdrawn across the ramp surface. A waste bin may be included adjacent the top of the sweeping ramp to receive waste swept up the ramp. A chute may be provided above the waste bin so that users may drop waste down the chute and into the waste bin.

20 Claims, 1 Drawing Sheet

FIG. 1
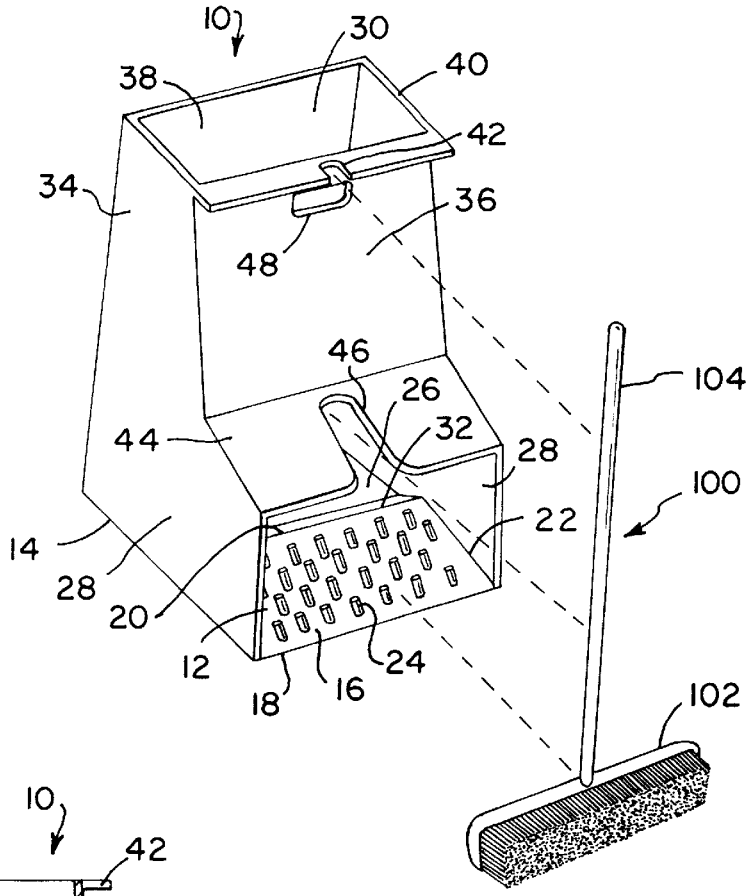
FIG. 2
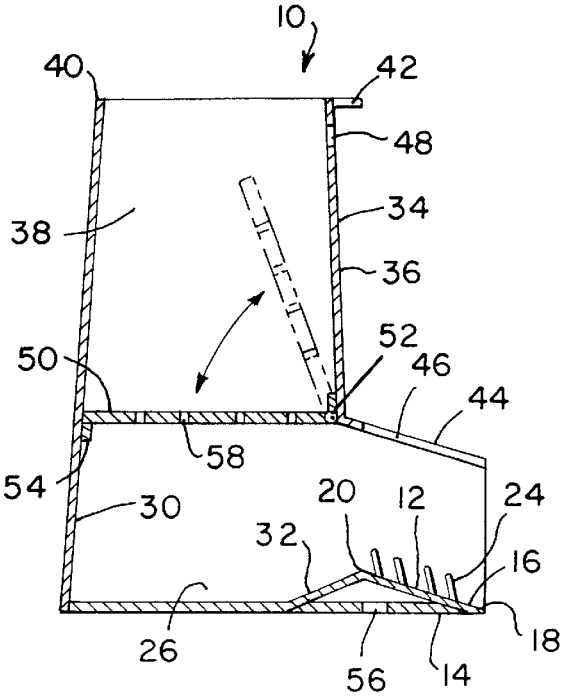
FIG. 3
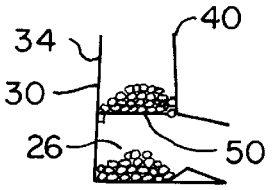
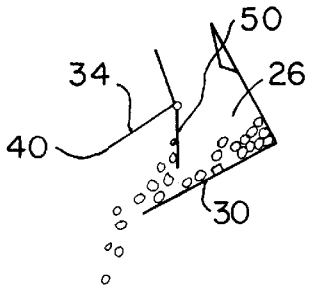
FIG. 4

WASTE RECEPTACLE WITH A SWEEPING RAMP HAVING PROTRUDING TEETH

FIELD OF THE INVENTION

This disclosure concerns an invention relating generally to waste receptacles, and more specifically to waste receptacles used to receive swept waste from brooms and similar cleaning implements.

BACKGROUND OF THE INVENTION

When cleaning personnel wish to dispose of waste swept from a floor, this is generally done by placing a dustpan on the floor and sweeping the waste into the dustpan. The dustpan can then be emptied into a garbage can or other waste receptacle. While this arrangement has been in almost universal use for centuries, it suffers from several disadvantages.

First, in locations where waste must be swept from the floor numerous times during the day, or where a large amount of waste is swept, the use of a dustpan can be tiresome. The user must stoop to the floor to properly orient the dustpan, sweep the waste therein, and then rise to carry the dustpan to the waste receptacle. This can cause or enhance back strain and other musculoskeletal ailments for cleaning personnel.

Second, the use of a dustpan and broom can be a nuisance because dustpans can be easily misplaced. As an example, during use, a dustpan is generally carried away from both the broom and the sweeping location to a waste receptacle, where it is emptied and left until it is again needed. However, the next time a user wants to sweep a location, the user must locate and collect both the dustpan and broom. This can be a nuisance because the dustpan and broom may be situated relatively distantly from each other. As another example, in locations where dustpans are often used, the dustpans are often stored by setting them within the waste receptacle and atop the waste resting therein. However, this can lead to the accidental disposal of a dustpan.

Third, standard dustpans have low storage capacity for swept waste and must be frequently emptied. Swept waste can easily spill from the dustpan as it is being carried to a waste receptacle, particularly where the waste has light weight (e.g., dust, hair, etc.) or is fluid.

Fourth, after the head of a broom is pushed into a dustpan to deposit waste therein, withdrawal of the broom head from the dustpan often tends to pull at least a portion of the deposited waste back out of the dustpan and onto the freshly-swept floor. As a result, repeated sweepings are often needed to fully deposit waste into dustpans. This is particularly true where statically-chargeable waste (e.g., styrofoam pellets) or fibrous material (e.g., hair in barbershops or pet grooming salons) is involved, since such waste tends to adhere to the bristles of the broom head.

SUMMARY OF THE INVENTION

The invention, which is defined by the claims set out at the end of this disclosure, is directed to a waste receptacle which solves the problems noted above and which has numerous additional advantages. In a preferred embodiment of the invention, the waste receptacle includes a sweeping ramp having teeth which protrude from the sweeping ramp at an angle such that the teeth are not parallel to the sweeping ramp. More preferably, the teeth protrude in a direction extending generally from the lower end of the ramp towards an upper end of the ramp. Thus, material may be swept up the ramp by a broom head, and the broom head can then be withdrawn by pulling it across the teeth to remove waste sticking to the broom bristles.

To allow brooms to be optimally cleaned of different types of waste at different times, the teeth may be made removable from the sweeping ramp. For example, individual teeth, sets of teeth, or one or more tooth-bearing sections of the sweeping ramp can be made removable and interchangeable with similar components having a different tooth configuration.

A waste bin may be included adjacent to (and preferably beneath) the upper end of the sweeping ramp. Material swept up the sweeping ramp and off of its upper end is therefore received within the waste bin for later disposal.

A bin ramp can extend from the upper end of the sweeping ramp into the waste bin so that the broom head may be smoothly pushed up the ramp, off the upper ramp end, onto the bin ramp, and into the waste bin to deposit swept waste. The broom head may then be smoothly withdrawn from the waste bin by sliding it up the bin ramp and down the sweeping ramp, rather than requiring the user to lift the broom to ensure that the broom head does not snag on the upper ramp end upon withdrawal.

The waste receptacle may include a tubular chute which has a chute passage directed onto the waste bin. Therefore, users can drop waste down the chute passage into the waste bin, as well as sweeping waste up the sweeping ramp and into the waste bin. The chute therefore allows the waste receptacle to be used in the same manner as a common wastebasket.

A flap may be hingedly affixed within the chute passage of the chute to effectively define a false floor. Waste can be dropped into the chute to accumulate atop the flap. As noted above, waste can also be swept up the sweeping ramp and into the waste bin. When users then tip the waste receptacle to pour the waste accumulated within the chute, the flap can fold away from the waste bin to open the chute passage. Thus, tipping the waste receptacle to empty the chute of waste can also allow waste from the waste bin to empty through the chute.

The walls of the chute (as well as any other upwardly-extending walls of the waste receptacle) are preferably inclined slightly inwardly as they extend upwardly. As a result, when the base of the waste receptacle is pushed against a wall, the surfaces of the waste receptacle situated above the base will extend away from the wall. This decreases the possibility that chute or other sections of the waste receptacle will scrape the wall.

The chute preferably has at least one notch, detent, or other broom handle retainer for receiving the handle of a broom or similar cleaning implement. This allows the cleaning implement to be propped against the waste receptacle with its handle held in the broom handle retainer in an upright, ready-to-use position. The broom handle retainer is desirably positioned approximately above the sweeping ramp so that the head of the cleaning implement may be situated within or adjacent the sweeping ramp.

Further advantages, features, and objects of the invention will be apparent from the following detailed description of the invention in conjunction with the associated drawings.

BRIEF DESCRIPTION OF THE DRAWINGS

FIG. 1 is a perspective view of an exemplary waste receptacle in conjunction with a broom.

FIG. 2 is a sectional side elevational view illustrating the waste receptacle of FIG. 1 as viewed from the plane 2—2.

FIG. 3 is a schematic view of the waste receptacle of FIGS. 1 and 2 illustrated with waste in its waste bin 26 and its chute 34.

FIG. 4 is a view of the waste receptacle of FIG. 3 in a tipped position with waste emptying from the waste bin 26 and chute 34.

DETAILED DESCRIPTION OF PREFERRED EMBODIMENTS OF THE INVENTION

In the drawings, a preferred embodiment of the waste receptacle is illustrated in FIGS. 1 and 2 at the reference numeral 10. The waste receptacle 10 includes a sweeping ramp 12 which is inclined with respect to the base 14 of the waste receptacle 10. The sweeping ramp 12 has a ramp surface 16 bounded by a lower ramp end 18, an opposing upper ramp end 20, and opposing ramp sides 22 extending between the lower and upper ramp ends 18 and 20. Teeth 24 extend from the ramp surface 16 at a non-zero angle with respect to the ramp surface 16, most preferably at an angle to the ramp surface 16 which inclines the teeth 24 toward the upper ramp end 20.

As particularly illustrated by FIG. 2, a waste bin 26 rests adjacent to and preferably below the upper ramp end 20. The waste bin 26 is to receive waste which is swept up the sweeping ramp 12 and off of the upper ramp end 20. Surrounding the waste bin 26 are side walls 28 (see FIG. 1) which also extend adjacent the ramp sides 22, and an end wall 30 spaced from the upper ramp end 20 and joined to the side walls 28. The side walls 28 and end wall 30 therefore define an enclosure about the sweeping ramp 12 and waste bin 26 to prevent spillage of waste swept up the sweeping ramp 12 and into the waste bin 26.

The portions of the waste receptacle 10 just described allow users to use a broom (as illustrated at 100 in FIG. 1) or similar cleaning implement having a head 102 and handle 104 to sweep waste from the floor, up the sweeping ramp 12, and into the waste bin 26. The head 102 may then be cleaned by withdrawing it from the waste receptacle 10 along the ramp surface 16 in the same manner that the head 102 entered the waste receptacle 10. The teeth 24 will thereby act to "comb" the bristles/strands of the head 102, clearing it of adhering waste. In the case where hair clippings are the waste to be swept (as is the case where the waste receptacle 10 is used in a beauty salon), a preferred tooth arrangement utilizes spacing whereby each tooth 24 is a rigid cylinder spaced approximately 2" from adjacent teeth 24. Additionally, the teeth 24 are approximately ⅜" long nearer the lower ramp end 18 and approximately ⅝" long nearer the upper ramp end 20, and are inclined by approximately 15° from a perpendicular to the ramp surface 16 toward the upper ramp end 20. Where other materials are to be swept, routine experimentation can yield the optimum tooth arrangement for best performance. Variation in tooth sizes (e.g., thick, thin, short, tall, etc.), angles (e.g., normal to the ramp surface 16 or otherwise), shapes (e.g., cylindrical, conical, hook-like, beam-like, elongated walls or ramps, etc.), spacing (e.g., fine or coarse spacing, regular or irregular staggering, etc.), and rigidity (e.g., rigid or flexible) can all be varied for best performance. Other features of the teeth 24, such as whether rows of teeth 24 are so sized and angled that they overlap with adjacent rows of teeth 24, can also be varied. Coarsely spaced teeth 24 are generally preferred because while finely spaced teeth 24 enhance removal of waste from the head 102 upon withdrawal, they can also resist the passage of the broom head 102 and hinder sweeping of waste into the waste bin 26. Additionally, it will generally be desirable to have teeth 24 having an overall height which is less than 2" from the ramp surface 16, since taller teeth 24 can also hinder the passage of the broom head 102 (at least for brooms 100 with shorter bristles).

Where different types of materials are to be swept into the waste receptacle 10 at different times, the waste receptacle 10 can make beneficial use of removable and replaceable teeth 24. For example, the teeth 24 illustrated in FIGS. 1 and 2 might be insertable in the ramp surface 16 in peg-like fashion so that different teeth 24 can be removed or inserted with different spacings. As another example, the sweeping ramp 12 may be made as a removable insert which snaps into place in the waste receptacle 10, and which can be removed and replaced by a sweeping ramp 12 having a different tooth arrangement. Using these or similar schemes, the arrangement of the teeth 24 can be modified to best suit the material being swept.

As is best illustrated in FIG. 2, where the waste bin 26 is defined by a depressed basin, a bin ramp 32 is preferably provided between the upper ramp end 20 and the end wall 30. The bin ramp 32 extends downwardly into the waste bin 26 so that if a user thrusts the broom 100 up the ramp surface 16 of the sweeping ramp 12, off the upper ramp end 20, and into the waste bin 26, the broom head 102 may be smoothly withdrawn from the waste bin 26 by pulling it up the bin ramp 32 and back down the sweeping ramp 12. In other words, the bin ramp 32 assists in preventing the broom head 102 from catching on the discontinuity that the upper ramp end 20 would form if the bin ramp 32 was not present.

Returning to FIGS. 1 and 2, the side walls 28 and end wall 30 may extend upwardly to form a section of a tubular chute 34, the circumference of which is completed by a forward chute wall 36. A chute passage 38 is thus defined within the chute 34 which extends from a top chute opening 40 to open onto the waste bin 26. As a result, waste can be deposited within the chute opening 40 so that the waste falls into the waste bin 26. As best shown by FIG. 2, the bottom of the forward chute wall 36 is preferably located within a plane which is located between the end wall 30 and the upper ramp end 20 when the plane is projected downwardly towards the base 14 of the waste receptacle 10. This particular alignment of the forward chute wall 36 helps to prevent waste dropped within chute passage 38 from falling onto the ramp surface 16 and thereby possibly being ejected from the sweeping ramp 12.

It is desirable to have the waste receptacle 10 incorporate some type of means for retaining the broom 100 in an upright and ready-to-use position on or adjacent the waste receptacle 10. As best illustrated by FIG. 1, this may be done by defining a notch 42 within the chute 34 (preferably adjacent the chute opening 40). The broom 100 can then be propped against the waste receptacle 10 with its handle 104 within the notch 42. This goal can be furthered by also providing a ramp ceiling 44 extending along the forward chute wall 36 and between the side walls 28, with the ramp ceiling 44 similarly including a broom handle notch 46. Thus, the broom 100 may have its head 102 placed on or adjacent the sweeping ramp 12 with its handle 104 aligned within the broom handle notches 42 and 46. The teeth 24 protruding from the ramp surface 16 are of assistance where the broom head 102 is placed on the sweeping ramp 12, since they will assist in preventing the broom head 102 from sliding off the ramp. Sliding of the broom head 102 may also be prevented by inclining the forward chute wall 36 inwardly towards the center of the chute passage 38 as the forward chute wall 36 extends upwardly.

In similar fashion, it is also preferable that the end wall 30, and also preferably the side walls 28, are inclined towards the center of the chute passage 38 as they extend in the upward direction. This arrangement is advantageous when the base of the waste receptacle 10 is pushed into abutment with a wall, since the inclination of the end wall 30 and/or side walls 28 will prevent them from scraping and/or leaving marks on the wall.

The chute 34 may include a handle 48 defined somewhere within its walls, ideally at the top of the forward chute wall 36. The handle 48 allows users to more easily carry the waste receptacle 10 from one location to another, and it additionally has other functions which will be discussed at greater length below.

A chute flap 50 may be hingedly affixed within the chute passage 38 at hinge 52. Ideally, the hinge 52 is located proximate the sweeping ramp 12, rather than at a point within the chute passage 38 which is on or proximate to the end wall 30. As a result of this arrangement, the chute flap 50 may fold along the arc partially illustrated in FIG. 2. A flap stop 54 is then preferably provided somewhere within the chute passage 38 and/or above the waste bin 26. The flap stop 54 prevents the chute flap 50 from folding completely into the waste bin 26 and thereby blocking waste on the sweeping ramp 12 from entering the waste bin 26.

The primary function of the chute flap 50 is to effectively provide a false floor within the chute 34 so that waste dropped within the chute opening 40 will collect and accumulate within the chute 34, rather than falling into (and rapidly filling) the waste bin 26. FIGS. 3 and 4 then illustrate how the waste receptacle 10 may be emptied of waste once the waste bin 26 and/or chute 34 are filled with waste. When the waste bin 26 and chute 34 are filled with waste, as illustrated in FIG. 4, a user may tip the waste receptacle 10 as illustrated in FIG. 4 so that waste from the waste bin 26 and the chute 34 flows down the end wall 30 and out the chute opening 40. The chute flap 50, being hinged to freely swing upwardly, will not hinder the flow of waste, particularly where the waste receptacle 10 is tipped sufficiently that the chute flap 50 swings farther away from the end wall 30. Tipping of the waste receptacle 10 is easily and conveniently performed by grasping the handle 48 in one hand and the ramp ceiling 44 in the other, and then lifting the waste receptacle 10 to achieve the desired degree of tipping. Alternatively or additionally, a handle aperture 56 (FIG. 2) may be defined in the base 14 of the waste receptacle 10 which can be gripped in accompaniment with handle 48 for purposes of tipping the waste receptacle 10.

It is noted that it is also preferable to have the flap stop 54 located so that the chute flap 50, when swung to its lowermost position (illustrated in solid lines in FIG. 2), is sloped slightly downwardly towards the end wall 30 rather than towards the sweeping ramp 12. With this arrangement, any liquid waste dropped into the chute opening 40 is more likely to flow towards the end wall 30 and waste bin 26 after striking the chute flap 50, rather than flowing towards the forward chute wall 36 and the sweeping ramp 12. As illustrated in FIG. 2, the chute flap 50 may include a number of drainage holes 58 so that liquid waste landing on the chute flap 50 may flow through the chute flap 50 and into the waste bin 26.

From the foregoing description, it should be appreciated that the waste receptacle 10 may be used both as a standard wastebasket, by dropping waste into the chute 34; it may be used a receptacle for swept waste materials, by sweeping waste into the waste bin 26; and it may also be used as a retainer for maintaining a broom in an upright and ready-to-use position adjacent to the receptacle for swept waste materials. The need to carry a dustpan from one location to another is eliminated since the waste receptacle 10 essentially functions as both a dustpan and a waste receptacle.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, it is noted that among the various inventive features included within the various embodiments of the waste receptacle 10, the use of a waste-retaining and broom-cleaning sweeping ramp 12 is regarded to be particularly valuable. Such a sweeping ramp 12 can be used in complex embodiments of the waste receptacle 10 such as the preferred embodiment described above, or could be used in simpler embodiments wherein the waste receptacle 10 resembles little more than a dustpan with a sweeping ramp 12 included therein. It is emphasized that the teeth 24 may be provided in a wide variety of different forms, as noted above, and the degree of waste retention and broom cleaning can vary with the tooth configuration used and the waste material being swept. As an example, the arrangement of coarsely spaced cylindrical teeth illustrated in FIG. 1 has been found to be highly effective for fibrous waste owing to its comb-like action, but it may not work as well for more particulate waste. As another example, a sweeping ramp utilizing teeth which resemble a series of upwardly-sloping ramps or plates arrayed in stepwise fashion might work well for sweeping of heavy particulates (e.g., metal powder), since the spaces/valleys between adjacent rows of teeth will catch particles that roll down the ramp or are pulled backwardly by a withdrawing broom head, and at the same time the stepwise ramp/plate scheme will allow the particles to be pushed upwardly towards the waste bin with minimal resistance.

Second, it is noted that the flap stop 54 need not have the structure illustrated in FIG. 2, and could instead be provided by other structure, e.g., structure on hinge 52 which gives the hinge 52 a delimited range of rotation.

Third, the means for retaining the broom handle 102, which is described above as notches 42/46, can take other forms and can be provided integrally or in attachment to the waste receptacle 10. As an example, rather than providing the broom handle retainer in the form of notch 42, it could be provided by a detent, pincers, or hook which engages the broom handle 102.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A waste receptacle comprising:

a. a sweeping ramp including a lower ramp end and an upper ramp end, the sweeping ramp bearing teeth protruding therefrom at a non-zero angle between the lower and upper ramp ends;

b. a waste bin having a bin floor defined beneath the upper ramp end.

2. The waste receptacle of claim 1 wherein the teeth protrude from the sweeping ramp to extend generally toward the upper ramp end.

3. The waste receptacle of claim 1:

wherein the sweeping ramp includes opposing ramp sides extending between the lower and upper ramp ends, further comprising upwardly-extending walls surrounding at least a portion of the upper ramp end and the ramp sides, wherein the waste bin is defined between the upper ramp end and the upwardly-extending walls.

4. The waste receptacle of claim 3 further comprising a tubular chute having a chute passage defined therein, the chute passage being directed onto the waste bin.

5. The waste receptacle of claim 4 further comprising a broom handle notch defined upon the tubular chute at an area of the tubular chute situated generally above the sweeping ramp.

6. The waste receptacle of claim 4 further comprising a flap hingedly affixed within the chute passage of the tubular chute.

7. The waste receptacle of claim 6 wherein the flap is foraminated.

8. The waste receptacle of claim 6 wherein the flap is rotatable into the chute passage to engage the tubular chute.

9. The waste receptacle of claim 8 wherein the flap, when engaging the tubular chute, slopes downwardly in a direction away from the sweeping ramp.

10. The waste receptacle of claim 3 further comprising a bin ramp descending from the upper ramp end into the waste bin.

11. The waste receptacle of claim 1:

wherein the sweeping ramp includes opposing ramp sides extending between the lower and upper ramp ends, further comprising sidewalls extending upwardly from the ramp sides, and an upwardly extending end wall between the sidewalls.

12. The waste receptacle of claim 11 wherein the waste bin is defined between the upper ramp end and the end wall, the waste receptacle further comprising a tubular chute having a chute passage defined therein, the chute passage being directed onto the waste bin.

13. The waste receptacle of claim 12 further comprising a broom handle notch defined upon the tubular chute at an area of the tubular chute situated generally above the sweeping ramp.

14. The waste receptacle of claim 12 further comprising a flap hingedly affixed within the chute passage of the tubular chute.

15. The waste receptacle of claim 11 further comprising a bin ramp descending from the upper ramp end, wherein the waste bin is depressed between the upper ramp end and the end wall.

16. The waste receptacle of claim 1:

wherein the sweeping ramp includes opposing ramp sides extending between the lower and upper ramp ends, the waste receptacle further comprising a waste bin situated beneath the upper ramp end, and a tubular chute having a chute passage defined therein, the chute passage being directed onto the waste bin.

17. The waste receptacle of claim 16 wherein the tubular chute includes an end wall situated generally opposite the upper ramp end and extending upwardly from the waste bin, and wherein the end wall is tilted inwardly so as to rest generally over the waste bin.

18. A waste receptacle comprising:

a. a sweeping ramp including a lower ramp end, an upper ramp end, and opposing ramp sides extending therebetween, wherein teeth extend from the sweeping ramp between its lower and upper ramp ends, b. a waste bin situated beneath the upper ramp end, and c. a tubular chute having a chute passage defined therein, the chute passage being directed onto the waste bin.

19. The waste receptacle of claim 18 wherein the teeth are inclined toward the upper ramp end.

20. A waste receptacle comprising:

a. a sweeping ramp including a lower ramp end, an upper ramp end, and opposing ramp sides extending therebetween, with teeth extending from the sweeping ramp between the upper and lower ramp ends at a non-zero angle, b. a waste bin situated beneath the upper ramp end, and c. a tubular chute having a chute passage defined therein, the chute passage being directed onto the waste bin.

* * * * *